US008037828B1

(12) United States Patent
Jakaboski et al.

(10) Patent No.: US 8,037,828 B1
(45) Date of Patent: Oct. 18, 2011

(54) PROJECTILE-GENERATING EXPLOSIVE ACCESS TOOL

(75) Inventors: Juan-Carlos Jakaboski, Albuquerque, NM (US); Chance G. Hughs, Tijeras, NM (US); Steven N. Todd, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 475 days.

(21) Appl. No.: 12/337,259

(22) Filed: Dec. 17, 2008

(51) Int. Cl.
*F42B 1/00* (2006.01)

(52) U.S. Cl. ..... 102/305; 86/50; 72/56; 72/706; 102/475

(58) Field of Classification Search ..... 102/305, 102/306, 475; 86/50; 72/55, 56, 706
See application file for complete search history.

(56) References Cited

U.S. PATENT DOCUMENTS

| | | | | |
|---|---|---|---|---|
| 4,499,828 | A | 2/1985 | Honodel | |
| 4,955,939 | A | 9/1990 | Petrousky et al. | |
| 5,187,319 | A * | 2/1993 | Nouguez et al. | 102/202.1 |
| 5,271,332 | A * | 12/1993 | Guirguis | 102/476 |
| 5,279,228 | A | 1/1994 | Ayer | |
| 5,522,319 | A | 6/1996 | Haselman, Jr. | |
| 6,220,166 | B1 | 4/2001 | Cherry | |
| 6,269,725 | B1 | 8/2001 | Cherry | |
| 6,817,297 | B1 | 11/2004 | Greene et al. | |
| 6,865,990 | B1 | 3/2005 | Greene et al. | |
| 6,966,263 | B1 | 11/2005 | Greene et al. | |
| 7,000,545 | B2 * | 2/2006 | Sansolo | 102/331 |
| 7,331,268 | B1 * | 2/2008 | Pangilinan et al. | 86/50 |
| 7,690,287 | B2 * | 4/2010 | Maegerlein et al. | 86/50 |

* cited by examiner

*Primary Examiner* — J. Woodrow Eldred
(74) *Attorney, Agent, or Firm* — Carol I Ashby

(57) ABSTRACT

An explosive device that can generate a projectile from the opposite side of a wall from the side where the explosive device is detonated. The projectile can be generated without breaching the wall of the structure or container. The device can optionally open an aperture in a solid wall of a structure or a container and form a high-kinetic-energy projectile from the portion of the wall removed to create the aperture.

16 Claims, 4 Drawing Sheets

PROJECTILE-GENERATING EXPLOSIVE ACCESS TOOL

The United States Government has rights in this invention pursuant to Department of Energy Contract No. DE-AC04-94AL85000 with Sandia Corporation.

BACKGROUND OF THE INVENTION

This invention relates to explosive devices that can open an aperture in a solid wall of a structure or a container and form a high-kinetic-energy projectile from the portion of the wall removed to create the aperture. This invention also relates to explosive devices that can generate a projectile without breaching the wall of a structure or a container. The projectile is generated from the opposite side of the wall from the side where the explosive device is detonated.

A number of devices have been patented that can open an aperture in a wall. Applications of such devices include creating an aperture in a container, such as a container for an improvised explosive device (IED). After opening the aperture, a disruptor that is not directly formed by the explosive action of the access tool can subsequently be projected through the opening to disrupt an IED and render it harmless. These devices are designed so that they do not generate a projectile from the wall of the container itself. An expressed goal of various devices is to produce an aperture without forming projectiles from the wall material of the wall being breached.

Honodel (U.S. Pat. No. 4,499,828) concerns a cone-shaped barrier breaching device designed primarily for opening holes in interior walls of buildings. The structure of the device is such that the sequence of detonation as detonation moves down the spokes and into the extensions of the cone results in an air-lens type operation. The structure of the device is such that there are no metallic forms such as found in conventional shaped charges that would result in shrapnel.

Chemy (U.S. Pat. No. 6,220,166) concerns an apparatus for explosively penetrating hardened containers such as steel drums without producing metal fragmentation. The explosive force generated by the explosive device causes the barrier to fail from an initial point and along intersecting failure lines that define a plurality of petals cantilevered from the barrier which are pushed back to define a fragment-free opening in the barrier.

Greene et al. (U.S. Pat. Nos. 6,817,297, 6,865,990, and 6,966,263) concern a no-fragment explosive access tool for soft metal containers that uses a flexible material preferably in a mostly square shape. An explosive charge is focused by grooves formed in a cutting plate such that the cutting plate forms a plurality of petals that press into a soft metal container to create a fragment-free opening in the soft metal target material.

BRIEF DESCRIPTION OF THE DRAWINGS

The accompanying drawings, which are incorporated in and form part of the specification, illustrate some embodiments of the present invention and, together with the description, serve to explain the principles of the invention.

DETAILED DESCRIPTION OF THE INVENTION

Figure 1:
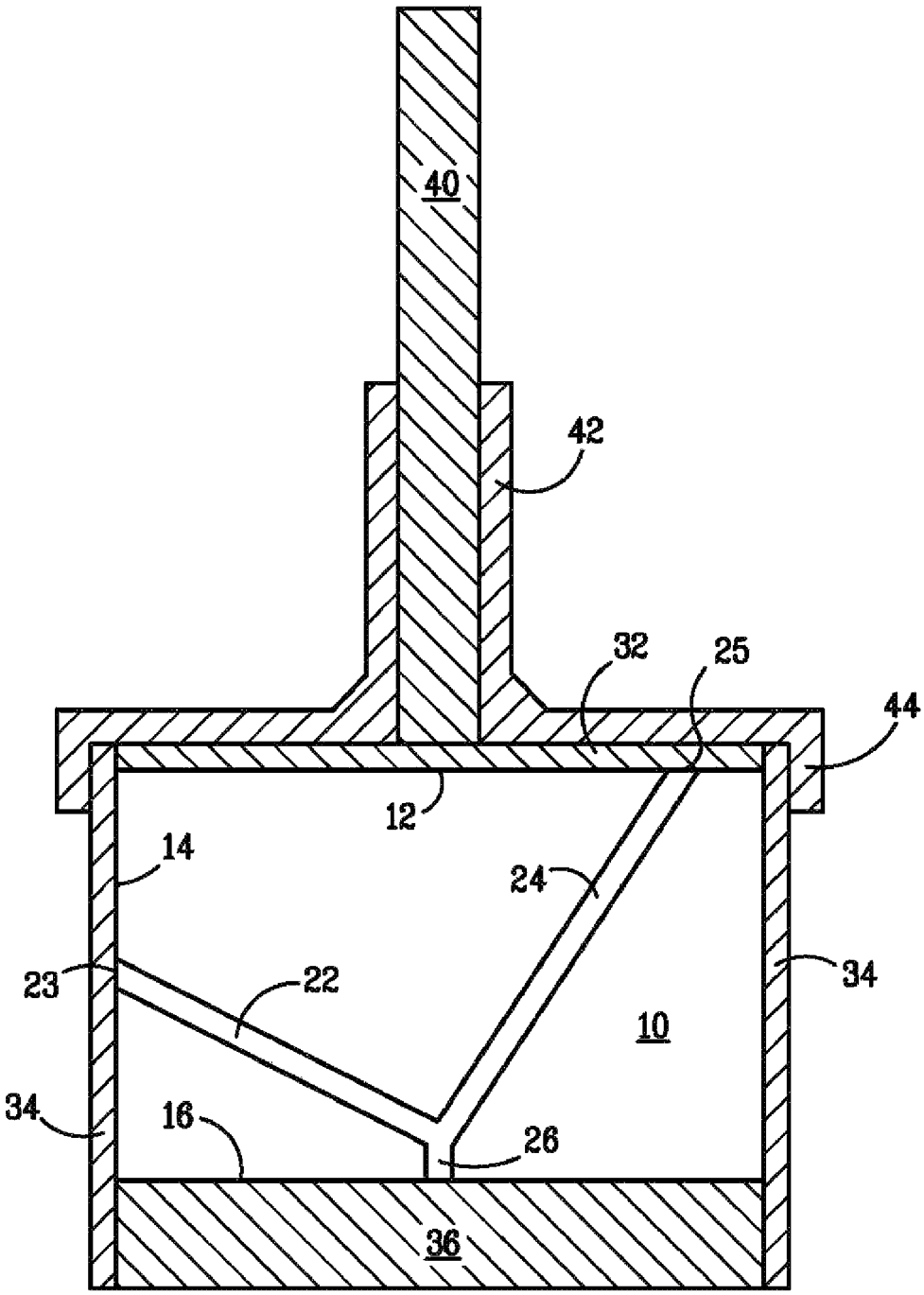
FIG. 1 presents a cross section of an embodiment of this invention comprising a cylindrical substrate structure and a plurality of conduits within the substrate structure.

This invention comprises an explosive device that employs colliding and reflecting shock waves to generate a projectile from a wall and optionally open an aperture in a wall against which or in close proximity to which the device is placed. In general, the PGD can generate a projectile if spaced from the target wall by up to approximately 20% of the thickness of the main explosive charge if the material between the surface of the PGD and the wall is transmissive of the patterned shock-wave. For example, in some applications, the PGD is attached to a wall using double-sided tape, hydragel, or a thin layer of plastic and double-sided tape, which adequately transmit the patterned shock waves. The structure of the projectile-generating device (PGD) produces detonation waves that travel from a top explosive layer to a side explosive layer to a main explosive charge. The geometry of the progression of the detonation waves leads to the initiation of the main charge from the perimeter region and optionally from an approximately central region. The detonation waves in the main charge collide and reflect to concentrate detonation wave energy in an approximately annular geometry. The geometric concentration of the detonation wave energy in the main charge induces a corresponding patterned shock wave in a wall structure proximate to the main explosive charge. The patterned shock wave causes an annular patterned structural failure of the wall material to produce a projectile whose lateral shape is similar to that of the patterned shock wave. Depending on the thickness of a wall and the explosive force generated by the device, the wall may or may not be breached during the generation of the projectile. In some embodiments, an aperture is formed in the wall. In such embodiments, the portion of the wall material that was circumscribed by the annular patterned shock waves becomes a projectile that is accelerated by the expansion of the gases generated in the detonation of the explosive. Some embodiments of this invention can be used as an explosive access tool (EAT) for obtaining access through a wall or other structural barrier to the region behind the wall. In some embodiments, the portion of the wall corresponding to the aperture is accelerated by the expanding gases resulting from the detonation process and becomes a substantially intact projectile. Some embodiments of this invention are useful for both opening an aperture in a wall, such as, for example, the enclosure of an explosive device such an IED, and for creating and accelerating a projectile that renders a device contained within or situated behind the wall inoperative. In some embodiments, a projectile is generated from the surface of the wall that is not proximate to the PGD without actually opening an aperture in the wall. In such embodiments, a projectile can be generated without actually breaching the wall with an aperture. Thus, a projectile can be generated without the potential of transport of gases or liquids from one side of the wall to the other side.

Embodiments of this invention are not simply shaped charge devices, which have explosive charges with a shaped cavity that forces the impact of the explosion to the front so that there is an armor-piercing force. Shaped charges are known as cavity charges, and the cavity generally extends most of the way into the total thickness of the shaped charge explosive. In many embodiments of the present invention including those described in detail herein, the surface of the main charge that is proximate to the structure to be penetrated is substantially flat. The surface in some embodiments can be convex or slightly concave, but it will not be deeply concave as in conventional shaped charges. The collision and reflection of detonation waves that produce the projectile and optionally the aperture does not require a deeply concave surface to produce the desired effect.

The projectile and aperture result from material structural failure in accordance with a geometric shape determined by the shape and structure of the explosive device in a particular embodiment. The shape of the explosive device can be different in various embodiments, where the particular shape depends on the shape of aperture or projectile that is desired. The shape can be approximately circular, oval, polygonal, or another geometric shape. For purposes of this invention, the terms annular and annulus are not restricted to the region between two concentric circles of different radii that constitutes a circular annulus. The terms encompass noncircular geometries where the annulus is defined by two approximately concentric shapes that are approximately mathematically similar and of a larger and a smaller size. In some embodiments, the annulus can be a rectangular annulus.

The specific geometry of a particular embodiment is predicated upon the physics of detonation waves in explosive materials. It is within the capability of one skilled in the explosive art to calculate the detonation wave geometric behavior for a particular device geometry using a particular explosive for a given embodiment. Based upon such, it is possible without undue effort to iteratively modify and refine an initial design to obtain the desired detonation wave patterns. One book which provides the necessary information to perform such calculations is Paul W. Cooper, "Explosives Engineering," 1996. Wiley-VCH, Inc. New York, N.Y.

In various embodiments, the explosive device fractures the solid structure using the collision and reflection of explosively induced stress waves in a region defined by the tool shape proximate to the wall structure. While some of the embodiments illustrated and/or described herein produce substantially circular apertures, it is to be recognized by those skilled in the explosive art that a wide range of geometric shapes can be formed when the structure of the PGD is designed to produce patterns of shock waves that correspond to the particular desired shape. Such shapes include but are not restricted to circles, ovals, polygons, and irregular shapes. The shape of the main charge may be cylindrical, oval, polygonal, or another geometric shape as desired by the user. For a particular embodiment, calculations based upon the well-understood physics of explosives and detonation propagation can be employed to determine a suitable PGD configuration to produce a particular aperture shape. The structure of the PGD is designed to produce collided and reflected shock waves that focus energy along the perimeter of what will become the projectile and optionally the aperture and consequently generate a projectile and optionally cut the aperture through the wall.

In some embodiments, the PGD fractures a region of a target structure and accelerates an intact solid projectile when placed in contact with a relatively thin target structure or causes extensive failure or damage in target structures with thicknesses too great for the induced shock waves to cause sufficient structural failure of the material to cut a hole through the entire thickness. For wall thicknesses too thick for complete penetration, a projectile can still be generated from the wall surface away from the PGD device, where a portion of the thickness of the wall is expelled as the projectile. In various embodiments, the main explosive charge can be at least approximately 0.75 times as thick as a steel wall for the PGD to reliably produce a projectile from the distal side or far side of the thick wall. This makes a projectile from the distal side with a diameter that is approximately equal to the PGD diameter and with a thickness of about 0.25 times the thickness of the steel wall.

The PGD comprises high explosives, and at least one substrate structure made from nonexplosive material. In some embodiments, a plurality of substrates sections may combine to serve as the substrate structure. In some embodiments, the substrate structure may be hollow or may be filled with a fluid. In some embodiments, the substrate structure may comprise a conduit for containing a means for initiating the main explosive charge at the outlet of the conduit, generating detonation waves that travel outward toward the perimeter of the main explosive charge while other waves are travelling inward from the perimeter. The main charge of high explosive is placed in contact with the target structure, such as, for example, the wall of a container or of a structure such as, for example, a building. In some applications, the main charge is proximate but not necessarily in direct contact with the wall; the position of the main charge is such that the detonation wave pattern can be transferred to the wall, forming shockwaves within the wall of the target structure that approximately replicate the detonation wave pattern. The target structure may consist of a wide range of solid materials, including but not restricted to metal, concrete, rock, wood, or any other material or combination of materials.

One embodiment of this invention is illustrated schematically in FIG. 1 in cross section. A substrate structure 10 that is approximately cylindrical comprises at least one conduit that connects either the top surface 12 or a side surface 14 of the substrate structure to the bottom surface 16, with the connection at the bottom surface being located approximately at the radial center of the substrate structure. The lateral dimension (radial dimension in a cylindrical embodiment) is selected to be approximately the same size as or larger than the projectile and optionally hole that are desired. The vertical dimension of the substrate structure is selected to be sufficiently thick to prevent break-through initiation of the main explosive charge from occurring. FIG. 1 illustrates an embodiment with two different conduit sections 22 and 24 that connect to the conduit 26 section that opens through the bottom surface 16 of the substrate structure. When the conduit section or sections are to be filled with explosive, the radius of the conduit is selected to be greater than the failure radius (the radial dimension below which detonation cannot be propagated) for the conduit explosive. A top explosive layer 32 is proximate to the top surface 12 of the substrate structure. In some embodiments, the top explosive layer comprises a sheet explosive. A side explosive layer 34 is proximate to the side surface 14 of the substrate structure 10. For the cylindrical embodiments of FIG. 1, the side explosive layer extends substantially completely around the side surface of the substrate structure. In non-cylindrical embodiments with multiple side segments, the side explosive layer is applied to each of the side segments. In some embodiments, the side explosive layer comprises a sheet explosive that is wrapped around the perimeter of the substrate structure. A detonator 40 is located proximate to the top explosive layer 32 and held in position with a detonator holder 42. For some detonator designs, a detonator holder may not be required. In various embodiments, alternative means for detonating the top explosive layer may be employed. A wide range of detonation means may be employed, as are known to those of skill in the explosive art. Examples include but are not restricted to a detonating-cord-initiated explosive detonator, a slapper detonator, an exploding bridgewire detonator, laser initiation of the explosive, and light-initiation of a layer of light-initiatable explosive proximate to the top explosive layer. The side explosive layer 34 is positioned proximate to the top explosive layer 32, and the top is partially enclosed by extensions 44 of the detonator holder 42. The side explosive layer 34 is positioned relative to the top explosive layer 32 such that a detonation wave propagating outward from the initial point of detonation of the top explosive layer can initiate detonation of the side explosive layer. In embodiments wherein the conduits are not filled with detonation-inducing means, detonation waves travel down through the side explosive layer 34 to the main explosive charge 36 and initiate detonation around the perimeter of the main explosive charge. This produces directed detonation waves in the main explosive charge that collide and reflect to concentrate detonation wave energy; the detonation wave energy is concentrated in an annular pattern. When the explosive device is proximate to a solid structure wall, it produces patterned shock-wave induction in the structure, causing material failure in the annular pattern defined by the shock-wave pattern, which is approximately the same as the detonation wave pattern in the main explosive charge.

In some embodiments of the general device illustrated in FIG. 1, a detonation-inducing means is present within at least one of the conduit sections 22 and 24 and in section 26. In some embodiments, the detonation-inducing means is an explosive substantially filling the conduit. For example, plastic explosive can be packed into one or more of the conduit section 22 and 24 and into conduit section 26. Initiation of the explosive in the conduit occurs either as the detonation wave in the top explosive layer 32 passes the proximate conduit opening 25 or as the detonation wave in the side explosive layer 34 passes the proximate conduit opening 23. When the conduit is of sufficient diameter to support detonation (greater than or equal to the failure radius for the explosive within the conduit), a detonation wave travels down the conduit to the center of the main explosive charge and initiates its detonation at the interface of the main explosive charge with the conduit. The detonation waves travel outward from the center and collide with the detonation waves travelling inward from the perimeter of the main explosive charge. An annular pattern of detonation waves is thereby formed, which can produce annular-patterned shock waves in an adjacent wall.

The dimension of the substrate and conduits and the explosive materials employed are selected to cause the detonation wave traversing the side layer explosive and the detonation wave travelling down the conduit to arrive at the main explosive charge at correlated times that produce the detonation waves in the main charge of high explosive that collide and reflect to produce the annular pattern of shock waves in the target that lead to localized failure of the adjacent wall material, thereby producing the desired size and shape of projectile and optionally of aperture.

In various embodiments, different detonation-inducing means can be employed in the conduit. Examples of detonation-inducing means include but are not restricted to high explosive, a projectile, and a propellant and primary explosive. One example of a projectile is a slapper detonator that is driven by explosive at the end of the conduit proximate to the top explosive layer or the side explosive layer (for example, at 23 or 25). The projectile travels down the conduit to strike the main charge and initiate detonation thereof through shock initiation. A propellant, such as, for example, smokeless powder, can be ignited by the side layer explosive or top layer explosive and subsequently initiate a primary explosive, such as lead azide, within the conduit. The primary explosive initiates the main explosive charge.

Changing the time of detonation at the center of the main explosive charge relative to the time of detonation at the perimeter of the main explosive charge can be employed to control the size of the projectile and optionally the aperture that are formed. For example, in the embodiment illustrated in FIG. 1, the size of aperture or projectile cut by the PGD can be selected by selecting either the top-initiated 24 or the side-initiated 22 conduit to contain explosive. If the top-layer-initiated path (conduit section 24) is filled with explosive, the shock collision occurs in a circular region with a larger radius. This can create a relatively large, relatively slow projectile. If the side-layer-initiated path (conduit section 22) is filled with explosive, one obtains a shock collision in a circular region with a smaller radius. This can create a relatively small, relatively fast projectile. A conduit can extend from the top explosive layer or from the side explosive layer directly to the main charge without intersecting a second conduit section such as section 26. An embodiment illustrating this direct form of conduit is in illustrated in FIG. 2, where the conduit extends from the center of the top explosive layer down to the center bottom surface of the substrate structure, where it contacts the main explosive charge, and in FIG. 3, where the conduit extends at an angle relative to the device radius from the top explosive layer to the center bottom surface of the substrate structure where it contacts the main explosive charge.

Figure 2:
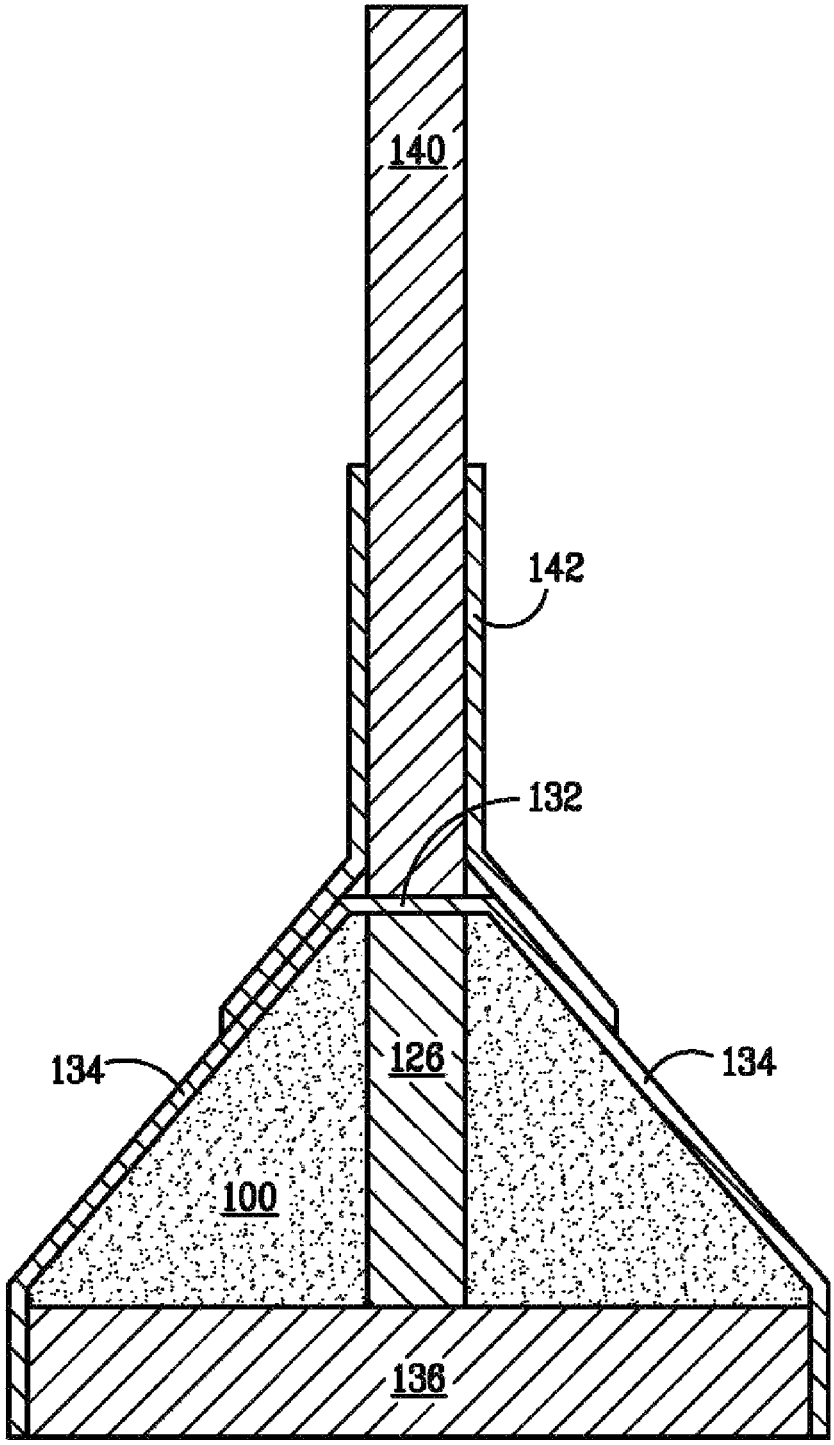
FIG. 2 presents a cross section of an embodiment of this invention comprising a conical substrate structure and a central conduit within the substrate structure.

FIG. 2 schematically illustrates another embodiment in cross section. The substrate structure 100 is a truncated conical structure with a conduit 126 passing approximately along the conical axis. The top explosive layer 132 is positioned atop the truncated cone. The side explosive layer 134 extends along the sides of the cone and past the bottom of the cone along the sides of the main explosive charge 136. The detonator holder 142 holds the detonator 140 proximate to the top explosive layer 132.

Figure 3:
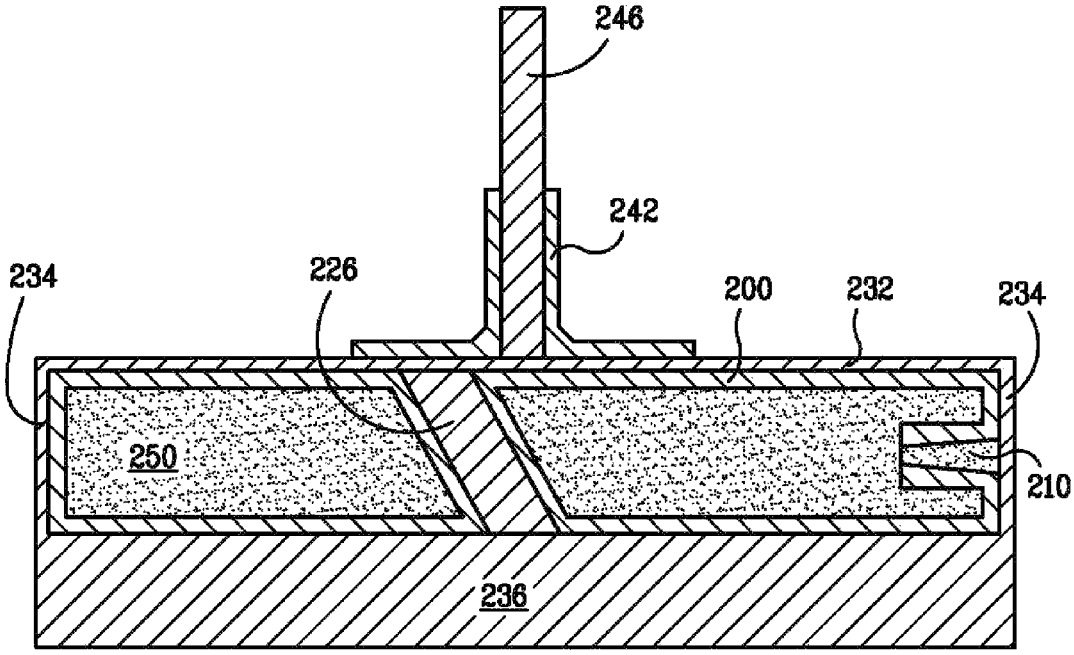
FIG. 3 presents a cross section of an embodiment comprising a hollow cylindrical substrate structure and an angularly offset conduit within the substrate structure. The hollow substrate structure comprises an orifice that can be used for introducing a fluid into the substrate structure.

FIG. 3 schematically illustrates another embodiment. In this embodiment, the substrate structure 200 is an approximately cylindrical hollow structure with a conduit 226 passing through it. The conduit can pass through the substrate structure at an angle selected to control the time at which the detonation-inducing means situated within the conduit is initiated by the detonation wave propagating outward from the detonator initiation point of the top layer explosive. The hollow structure can be filled with a liquid through an orifice that is sealed with a plug 210. The top explosive layer 232 is positioned atop the substrate structure 200, with a detonator holder 242 holding a detonator 246 in position above approximately the radial center of the substrate structure. The side explosive layer 234 is proximate to the side of the substrate structure and in sufficient contact with the top explosive layer as to permit its initiation by the outward propagating detonation wave of the top explosive layer. The main explosive charge 236 is in contact or within initiation-enabling proximity with the side layer explosive and the detonation-inducing means within the conduit. In some embodiments, the detonation-inducing means is high explosive. The hollow region 250 of the substrate structure can be filled with liquid, such as water or with a particulate solid, such as aluminum powder and magnesium powder. Other particulate solids that are capable of being poured into the substrate structure to at least partially fill the hollow region can also be used. Particulate solids that can be ignited can prolong the pressure impulse on the target.

In various embodiments, a casing can be placed around portions of the explosive device to protect the explosive layers and optionally to define cavities into which high explosive can be placed to form at least one of the top explosive layer, side explosive layer, and the main explosive charge.

Figure 4:
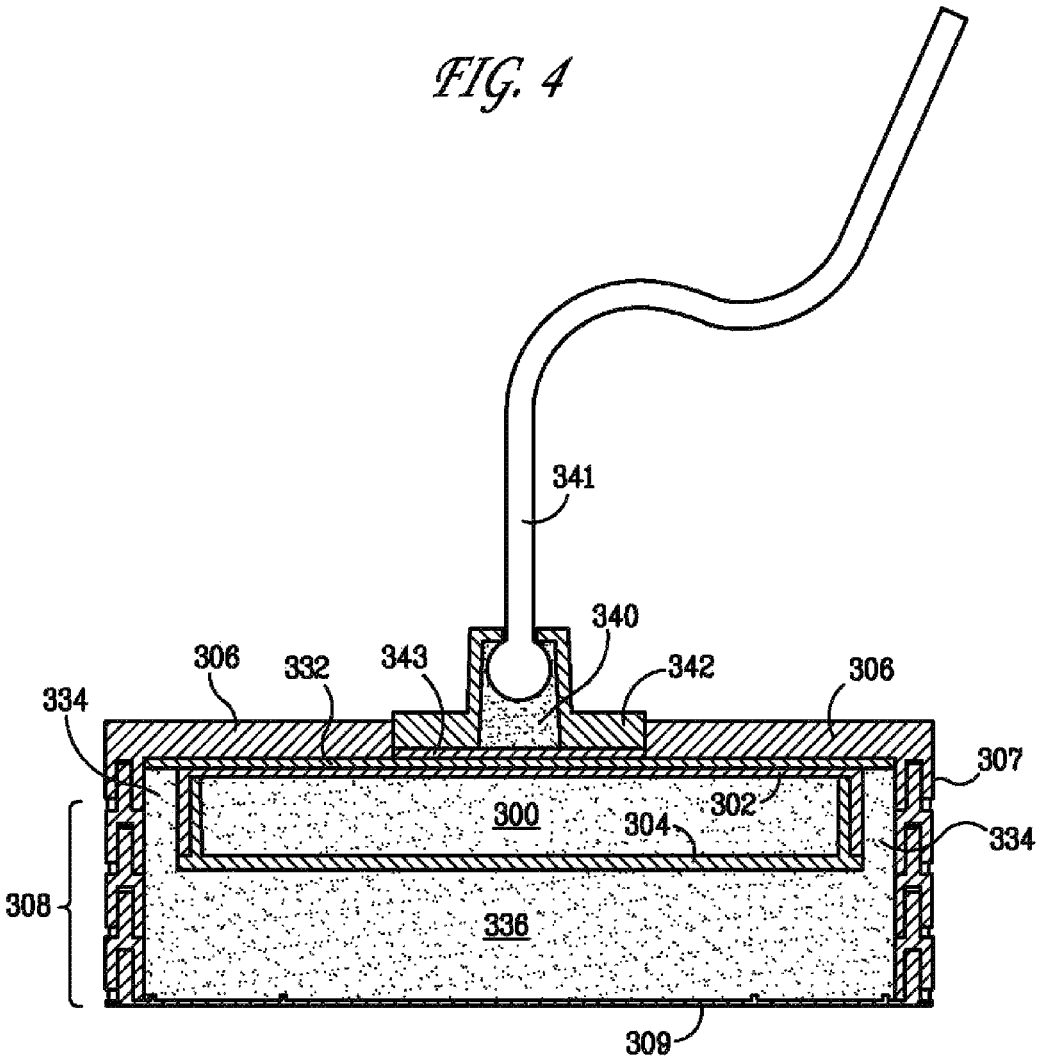
FIG. 4 presents a cross section of an embodiment comprising a cylindrical substrate structure and a casing structure for containing the high explosive material comprising the side explosive layer and the main explosive charge.

FIG. 4 illustrates an embodiment employing a casing. A substrate structure 300 comprises two interlocking structures 302 and 304 that are pressed together to form the hollow substrate structure. The top casing section 306 comprises an inner surface against which the top layer explosive is placed. The outer surface structure of the top casing can be widely varied in different embodiments. In the embodiment of FIG. 4, an aperture is located at the radial center of the top casing section; the detonator holder 342 is inserted into the aperture. The detonator holder 342 holds in position a detonating cord 341 and a detonator explosive 340. To insure good contact between the detonator explosive in the detonator holder and the top explosive layer, a layer of sheet explosive 343 can be inserted between the top explosive layer 332 and the detonator explosive 340 to promote reproducible progress of the detonation into the top explosive layer 332. The top explosive layer is sandwiched between the top casing section 306 and the top portion 302 of the substrate structure 300. The top explosive layer extends past the perimeter of the substrate structure. A mating structure 307 is located at the perimeter of the top casing section. A side casing section 308 is mated to the mating structure 307 of the top casing section 306. The side casing section can comprise a single structure or can comprise a plurality of stacked, mated structures; in FIG. 4, the side casing structure comprises mated rings that stack together to determine the depth of the cavity that will be filled with the main explosive charge. By varying the number of rings and/or the height of individual rings, the amount of explosive comprising the main explosive charge can be controllably and easily varied in different embodiments. An annular cavity is formed between the substrate structure 300 and the inner surface of the top casing mating structure 307 and optionally a portion of the side casing section 308. This annular region 334 is filled with explosive, such as plastic explosive to provide the side explosive layer. The explosive fills the annular cavity and is in contact with the top explosive layer such that the detonation waves of the top explosive layer can propagate controllably into the side explosive layer. The side casing section extends past the bottom structure 304 of the substrate structure 300 to provide a cavity for filling with the main explosive charge 336. Optionally, a bottom casing section 309 that is mated to the side casing section 308 encloses the main explosive charge. The thickness of the bottom casing section is selected to enable passage of the shock waves through the bottom casing section into the proximate wall that is to produce the projectile and optionally to be breached.

FIG. 4 shows rings mated using a tongue-and-groove joint, but a wide range of mating structures can be used in different embodiments of this invention. For example, the mating structures can comprise tongue and groove joints, biscuit joints, butterfly joints, butt joints, dowel joints, cope and stick joints, finger joints, mortise and tenon joints, post and hole joints, splice joints, dado joints, mitre joints, dovetail joints, lap joints, welded lap joints, and joints fastened with fasteners such as bolts, screws, rivets, adhesives, and adhesive tapes. Other types of joints and fasteners can also be used in embodiments of this invention.

The first explosive layer and the second explosive layer are made of high explosive. This high explosive surrounds the sides of substrate or substrates. Additionally explosive may be within a conduit within the substrate or substrates. These explosives transmit the detonation waves from one or more detonators to the main charge of high explosive. The main explosive charge and the other explosives may consist of a wide range of types of explosives. The top explosive layer, the side explosive layer, and the main explosive charge can be the same explosive or different explosives. Examples of high explosives suitable for use in various embodiments of this invention include but are not restricted to explosives selected from the group consisting of trinitrobenzene (TNB), trinitrotoluene (TNT), trinitrobenzoic acid (TNBA), trinitroaniline (TNA), tetryl, ethyl tetryl, picric acid, ammonium picrate, methyl picrate, ethyl picrate, picryl chloride, trinitroxylene (TNX), trinitrocresol, styphnic acid, lead styphnate, triaminotrinitrobenzene (TATB), hexanitroazobenzene (HNAB), hexanitrostilbene (HNS), tetranitrodibenzotetrazapentalene, tetranitrocarbazole (TNC), tetranitrodibenzotetrazapentalene (TACOT), methyl nitrate, nitroglycol, nitroglycerine, erythritoltetranitrate, mannitol hexanitrate, pentaerythritol tetranitrate (PETN), pentaerythritol trinitrate (PETRIN), ethylenedinitamine (EDNA), nitroguanidine (NQ), nitro urea, cyclo-1,3,5-trimethylene-2,4,6-trinitramine (RDX), cyclotetramethylenetetranitramine (HMX), tetranitroglycolurile, mercury fulminate, lead azide, silver azide, and ammonium nitrate. These explosives may be blended with other explosives or inert materials, for example, as pressings, castings, plastic bonded forms, plastic machined forms, putties, rubberized forms, extrudable forms, binary forms, blasting agents, slurries, gels, and dynamites.

Explosion of the PGD produces patterned shock waves in a proximate wall that fracture the wall structure to produce a projectile using collision and reflection of explosively induced stress waves. The stress waves are induced in the wall by the detonation waves in the explosive producing shock waves in the wall.

In various embodiments, the substrate structure may comprise a variety of nonexplosive materials such as plastic, wood, wax, rubber, fabric, metal, or other materials. In various embodiments, the substrate structure is designed such that the main charge is initiated along one or more perimeter surfaces and/or at one or more approximately central points. This creates a situation in which there are both converging and diverging detonation waves within the main charge. These diverging and converging detonation waves induce similar shock waves within the target structure. These shock waves collide and interfere with one another in the target structure, exceeding the tensile strength of the target material. In various embodiments, one or more subunits may be combined to form the substrate structure. In various embodiments, the design of the substrate structure in combination with the high explosive creates a designed and predictable collision of shock waves in the target structure in the shape of a circle, rectangle, triangle, polygon, oval, irregular shape, or any other geometry. The substrate structure is designed to possess sufficient thickness and density to prevent unintended, premature initiation of the main charge. For example, a substrate that is too thin may allow the initiation of the main charge at unintended points or along unintended paths. In such cases, the detonation can effectively "jump" through the substrate and initiate the main charge instead of traveling along the intended path, such as through the top explosive layer and side explosive layers. Substrate thickness is selected to avoid unintentional jump-through of the detonation.

In embodiments where there are holes and/or cavities within the substrate that are used to control one or more locations of detonation of the main charge, the holes and/or cavities are designed to be conduits of a size sufficient for the high explosives packed therein to initiate and detonate reliably. If the holes and cavities are too small, that is, below the so-called critical diameter or failure radius of the particular explosive or explosives employed in an embodiment, then the detonation of the conduit explosive may slow down or cease altogether, leading to reduction in control of the initiation of the main charge. Initiation of the main explosive charge approximately at its center and at its perimeter induces shock waves in the solid structure proximate to the main charge that collide and reflect. For example, when two shock waves collide, they briefly create pressures in the target material equal to 2 to 3 times the pressure of one shock wave. Also, when the shock waves collide, interfere, and reflect from one another, they briefly create negative pressures that exceed the tensile strength of the solid structure, thereby fracturing it. The reflected shock waves exceed the tensile strength of the solid structure, thereby fracturing the solid structure where shock wave intensity is concentrated and forming a projectile approximating the shape of the base of the PGD. Expanding detonation product gases accelerate the projectile when the wall thickness permits opening of an aperture.

For sufficiently thin target structures, the PGD will create a projectile from the plug cut from the target structure by the annular shock wave pattern and accelerate that projectile. The projectile will have a shape that corresponds to the annulus created by the PGD. For thicknesses of target structures exceeding those from which holes are formed and from which projectiles are generated, the PGD will cause extensive failure and damage to the target structures. Two or more PGDs may be detonated simultaneously or at slightly different times to create additional regions within the target structure where shock waves collide and interfere with one another, thereby exceeding the tensile strength of the target structure and causing it to fail.

In some embodiments, to enhance the effects of the main explosive charge, the substrates may be filled or surrounded by other inert materials such as water, sand, metal, or chemically reactive materials such as aluminum or magnesium. The explosive causes the chemically reactive material such as aluminum or and magnesium to burn, adding energy to the explosive event, which prolongs the pressure impulse against the target and does more work on the target.

In some embodiments, the PGD comprises a hollow substrate, a detonator, a detonator holder, and high explosive in a top layer, a side layer, and as the main explosive charge. The main explosive charge can comprise the preponderance of the high explosive; in some embodiments, it comprises a base plate of sheet explosive that is placed substantially in contact with the solid structure from which the projectile is to be generated. The remaining high explosive is configured to surround the substrate structure and/or fill regions around the substrate structure. The high explosive in the top and side layers transmits a detonation wave from a detonator to the main explosive charge. Initiation of the main explosive charge approximately at its center and at its perimeter induces shock waves in the solid structure that collide and reflect. When two shock waves collide, they create pressures in the target material for a few microseconds equal to 2 to 3 times the pressure of one shock wave. Also, when the shock waves collide, interfere, and reflect from one another, they create negative pressures for a few microseconds that exceed the tensile strength of the solid structure, thereby fracturing it. The reflected shock waves exceed the tensile strength of the solid structure, thereby fracturing the solid structure and forming a projectile approximating the shape of the base of the PGD. When an aperture is formed, expanding detonation product gases accelerate the projectile.

The substrate, which may be hollow in some embodiments, serves as a structural member around which the side explosive layer explosive is wrapped or packed. In some embodiments, the geometry of the substrate is selected to allow synchronized detonation of the main explosive charge at approximately its center and its perimeter. To enhance the effects of the high explosive, the hollow substrate may be filled with a fluid, such as, for example, water, through an orifice, as illustrated schematically in FIG. 3. In some embodiments, there may be more than one orifice or opening. Once filled, the fluid may be sealed in the hollow substrate chamber using sealing fixtures, such as, for example rubber plugs.

For a given diameter of main charge and thickness of main charge of explosive, there will be a target thickness that is too thick for the shock waves to form a projectile on the back side. For a circular PGD, the diameter of the projectile is approximately equal to or less than the diameter of the PGD. In some demonstrated embodiments, PGDs with diameters of approximately 6 inches have been employed, but a wide range of diameters both larger and smaller can also be employed. The diameter can be selected to produce the diameter of projectile that is desired. In some embodiments where a projectile is being formed and ejected from the back side of a wall without creating a hole through the wall, the thickness of the main explosive charges is selected to be equal to approximately ¾ times the thickness of a steel wall. This will generate a projectile from the back side of the wall with a diameter approximately equal to the diameter of the EAT and with a thickness of approximately ¼ times the thickness of a steel wall. In some embodiments, the thickness of the projectile is approximately ¼ to ½ times the thickness of the wall, with the projectile thickness depending on the amount of explosive used and the material of the wall, for example steel or aluminum. For aluminum, which is less dense, a projectile from the back side of the wall is approximately ½ times the thickness of the aluminum wall. Projectiles and optionally holes can be generated in various types of steel including but not restricted to low tensile strength mild steel, stainless steel, very high tensile strength alloy steel, and rolled homogeneous armor. For some embodiments, the density of the materials, the density of the explosive and the Gurney equations from the book by Cooper (Paul W. Cooper, "Explosives Engineering," 1996. Wiley-VCH, Inc. New York, N.Y.) can be used to predict workable combinations of explosive and wall thicknesses.

For example, for a 1-inch-thick steel target and a 2-inch-diameter EAT with a ¾-inch-thick main charge, one obtains a 2-inch-diameter projectile of a thickness of approximately ¼ inch ejected from the back side of the wall. The texture of the surface of the wall remaining after ejection of the projectile is relatively rough due to the brittle fracture that occurs where the shock waves collide and rebound. The reproducibility of projectiles produced with the same PRG design is good, with projectiles being approximately the same size within approximately ±2% by mass. In part due to the random distribution of voids and defects within a metal wall, the brittle fracture will occur in slightly different areas within the metal wall so that each projectile will be slightly different from other projectiles generated with the same design of PGD. In embodiments where the wall is not completely penetrated, the region on the back side of the wall is not exposed to the blast and heat present on the side of the wall where the PGD is located.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. An explosive device to provide patterned shock-wave induction in a structure, comprising:

a substrate structure, the substrate structure having a top surface, at least one side surface, and a bottom surface;

a top explosive layer proximate to the top surface of the substrate structure;

a detonator located proximate to the top explosive layer for initiation of the top explosive layer and generation of an outward propagating detonation wave;

a side explosive layer proximate to the side surface of the substrate structure, wherein the side explosive layer is initiatable by the outward propagating detonation wave; and a main explosive charge proximate to the bottom surface of the substrate structure, wherein the main explosive charge is initiatable by detonation waves from the side explosive layer, wherein an initiation of the main explosive charge by the detonation waves from the side explosive layer produces directed detonation waves in the main explosive charge that collide and reflect to concentrate detonation wave energy and provide patterned shock-wave induction in the structure which is located proximate to the main explosive charge.

2. The explosive device of claim 1, further comprising:

at least one conduit through the substrate structure, the conduit extending from at least one of the top explosive layer and the side explosive layer to the main explosive charge, and a detonation-inducing means within the conduit.

3. The explosive device of claim 2, wherein a bottom-surface aperture of the conduit is located approximately at a center location of the bottom surface of the substrate.

4. The explosive device of claim 2, wherein the detonation-inducing means is selected from the group consisting of an explosive, a detonation-initiating projectile, and a propellant in combination with a primary explosive, wherein the propellant is ignitable by at least one of the side explosive layer and the top explosive layer during detonation and wherein the propellant after ignition can initiate a primary explosive proximate to the main explosive charge.

5. The explosive device of claim 1, wherein the substrate structure is at least partially hollow.

6. The explosive device of claim 5, wherein the substrate structure comprises at least one port for filing with a fluid or a particulate solid.

7. The explosive device of claim 1, wherein the substrate structure is cylindrical, elliptical cylindrical, polygonal prismatic, conical, truncated conical, pyramidal, or truncated pyramidal.

8. The explosive device of claim 1, wherein the top explosive layer, the side explosive layer, and the main explosive charge comprise explosives selected from the group consisting of trinitrobenzene, trinitrotoluene, trinitrobenzoic acid, trinitroaniline, tetryl, ethyl tetryl, picric acid, ammonium picrate, methyl picrate, ethyl picrate, picryl chloride, trinitroxylene, trinitrocresol, styphnic acid, lead styphnate, triaminotrinitrobenzene, hexanitroazobenzene, hexanitrostilbene, tetranitrodibenzotetrazapentalene, tetranitrocarbazole, tetranitrodibenzotetrazapentalene, methyl nitrate, nitroglycol, nitroglycerine, erythritoltetranitrate, mannitol hexanitrate, pentaerythritol tetranitrate, pentaerythritol trinitrate, ethylenedinitamine, nitroguanidine, nitro urea, cyclo-1,3,5-trimethylene-2,4,6-trinitramine, cyclotetramethylenetetranitramine, tetranitroglycolurile, mercury fulminate, lead azide, silver azide, and ammonium nitrate, combinations thereof, and combinations thereof with inert materials.

9. The explosive device of claim 1, wherein the top explosive layer and the side explosive layer comprise sheet explosive.

10. The explosive device of claim 1, further comprising:

a casing comprising at least one of a top casing section proximate to the top explosive layer, a side casing section proximate to the side explosive layer, and a bottom casing section proximate to a bottom of the main explosive charge.

11. The explosive device of claim 1, further comprising:

a casing comprising at least one of a top casing section proximate to the top explosive layer, a side casing section proximate to the side explosive layer, and a bottom casing section proximate to a bottom of the main explosive charge, wherein the top casing section is connected to the side casing section and the side casing section is connected to the bottom casing section.

12. The explosive device of claim 11, wherein the top casing section comprises a plate comprising a detonator access port approximately centrally located in the plate, the top casing section further comprising a mating structure located at a perimeter of the plate for joining the top casing section to the side casing section, wherein the top explosive layer is proximate to an inner surface of the top casing section and wherein the top explosive layer is substantially limited in lateral extent by the mating structure, and wherein the side casing section comprises at least one ring with an inner ring surface, the at least one ring having a greater inner diameter than an outer diameter of the substrate structure, thereby providing an annular cavity between the side surface of the substrate structure and the inner ring surface for containing the side explosive layer and wherein a height of the side casing section is greater than the thickness of the substrate structure, and wherein the explosive device of claim 1 further comprises a cavity for filling with the main explosive charge, wherein the cavity is formed at least in part by the bottom surface of the substrate structure and the side casing section.

13. The explosive device of claim 12, wherein the bottom casing section comprises a ring mating structure located at or near a perimeter of the bottom casing section for joining the bottom casing section to the side casing section, the bottom casing section being proximate to the main explosive charge.

14. The explosive device of claim 12, wherein the side casing section comprises a plurality of rings stacked to form the side casing section.

15. The explosive device of claim 11, wherein the mating structure comprises a joint selected from the group consisting of a tongue and groove joint, a biscuit joint, a butterfly joint, a butt joint, a dowel joint, a cope and stick joint, finger joint, mortise and tenon joint, a post and hole joint, a splice joint, a dado joint, a mitre joint, a dovetail joint, a lap joint, a welded lap joint, and a joint fastened with a fastener selected from the group consisting of a bolt, a screw, a rivet, an adhesive, and an adhesive tape.

16. The explosive device of claim 1, wherein the detonator is selected from the group consisting or a detonating-cord-initiated explosive detonator, a slapper detonator, an exploding bridgewire detonator, a laser-initiated explosive detonator, and light-initiated detonator comprising a layer of light-initiatable explosive.

* * * * *